US007070128B2

(12) United States Patent
Delas

(10) Patent No.: US 7,070,128 B2
(45) Date of Patent: Jul. 4, 2006

(54) FUEL INJECTION VALVE

(75) Inventor: Zlatko Delas, Vaihingen (DE)

(73) Assignee: Robert Bosch GmbH, Stuttgart (DE)

( * ) Notice: Subject to any disclaimer, the term of this patent is extended or adjusted under 35 U.S.C. 154(b) by 503 days.

(21) Appl. No.: 10/399,333

(22) PCT Filed: Jun. 14, 2002

(86) PCT No.: PCT/DE02/02176

§ 371 (c)(1),
(2), (4) Date: Apr. 16, 2003

(87) PCT Pub. No.: WO03/027487

PCT Pub. Date: Apr. 3, 2003

(65) Prior Publication Data

US 2005/0258276 A1 Nov. 24, 2005

(30) Foreign Application Priority Data

Aug. 29, 2001 (DE) ..... 101 42 302

(51) Int. Cl.
*B05B 1/30* (2006.01)
*F02M 51/00* (2006.01)

(52) U.S. Cl. ..... 239/585.5; 239/585.1

(58) Field of Classification Search ..... 239/585.5, 239/585.1, 585.4, 533.9, 533.11, 585.3, 533.2; 251/129.15, 129.16, 129.18
See application file for complete search history.

(56) References Cited

U.S. PATENT DOCUMENTS

| | | | | |
|---|---|---|---|---|
| 4,944,486 | A | 7/1990 | Babitzka | |
| 4,967,966 | A * | 11/1990 | Babitzka et al. | 239/585.4 |
| 5,360,197 | A * | 11/1994 | Reiter et al. | 251/129.21 |
| 5,875,975 | A | 3/1999 | Reiter et al. | |
| 6,357,676 | B1 * | 3/2002 | Hanft | 239/585.1 |

FOREIGN PATENT DOCUMENTS

| | | |
|---|---|---|
| DE | 195 03 224 | 8/1996 |
| DE | 196 26 576 | 1/1998 |
| DE | 197 44 739 | 4/1999 |
| EP | 1 092 865 | 4/2001 |
| GB | 880 369 | 9/1961 |
| JP | 59 201966 | 11/1984 |

OTHER PUBLICATIONS

Patent Abstracts of Japan, vol. 009, No. 070 (M-367, Mar. 30, 1985).

* cited by examiner

*Primary Examiner*—David A. Scherbel
*Assistant Examiner*—Darren Gorman
(74) *Attorney, Agent, or Firm*—Kenyon & Kenyon LLP

(57) ABSTRACT

A fuel injector includes a magnetic coil, which cooperates with an armature acted upon by a restoring spring, the armature forming an axially movable valve part together with a valve needle. A valve-closure member which forms a sealing seat with a valve-seat member is provided at the valve needle. Furthermore, the fuel injector includes an inner pole and an outer pole which form a magnetic circuit with the magnetic coil. The restoring spring is acted upon by a guide sleeve so that its axial length during operation of the fuel injector is smaller than the axial length of a bore of the inner pole.

5 Claims, 1 Drawing Sheet

FUEL INJECTION VALVE

FIELD OF THE INVENTION

The present invention relates to a fuel injector.

BACKGROUND INFORMATION

As an example, German Published Patent Application No. 196 26 576 describes an electromagnetically actuable fuel injector, in which, for the electromagnetic actuation, an armature cooperates with an electrically energizable magnetic coil, and the lift of the armature is transmitted to a valve-closure member via a valve needle. The valve-closure member cooperates with a valve-seat surface to form a sealing seat. A plurality of fuel channels is provided in the armature. The armature is reset by a resetting spring.

A feature of the fuel injector described in German Published Patent Application No. 196 26 576 is that the restoring spring is braced directly against the armature or an inflow-side end of the valve needle. The bore of the inner pole in which the restoring spring is arranged has a smaller caliber than the armature bore, so that the restoring spring may shift during the operation of the fuel injector. As a consequence, the restoring spring may tilt, resulting in locking and wear manifestations with subsequent malfunctions of the fuel injector.

SUMMARY OF THE INVENTION

In contrast, an exemplary fuel injector according to the present invention may provide a more appropriate contact surface of the restoring spring at the guide sleeve so that the spring may be less likely to shift. Wear may be reduced, and the restoring spring may be unable to tilt. Since the restoring spring may not leave the bore of the inner pole, malfunctions of the fuel injector may be prevented.

The guide sleeve may be produced by turning.

The guide sleeve may be mounted with the valve needle and the armature.

The sphere-segment shape of the guide section of the guide sleeve may allow a low-friction guidance in the bore of the inner pole.

DETAILED DESCRIPTION

Figure 1:
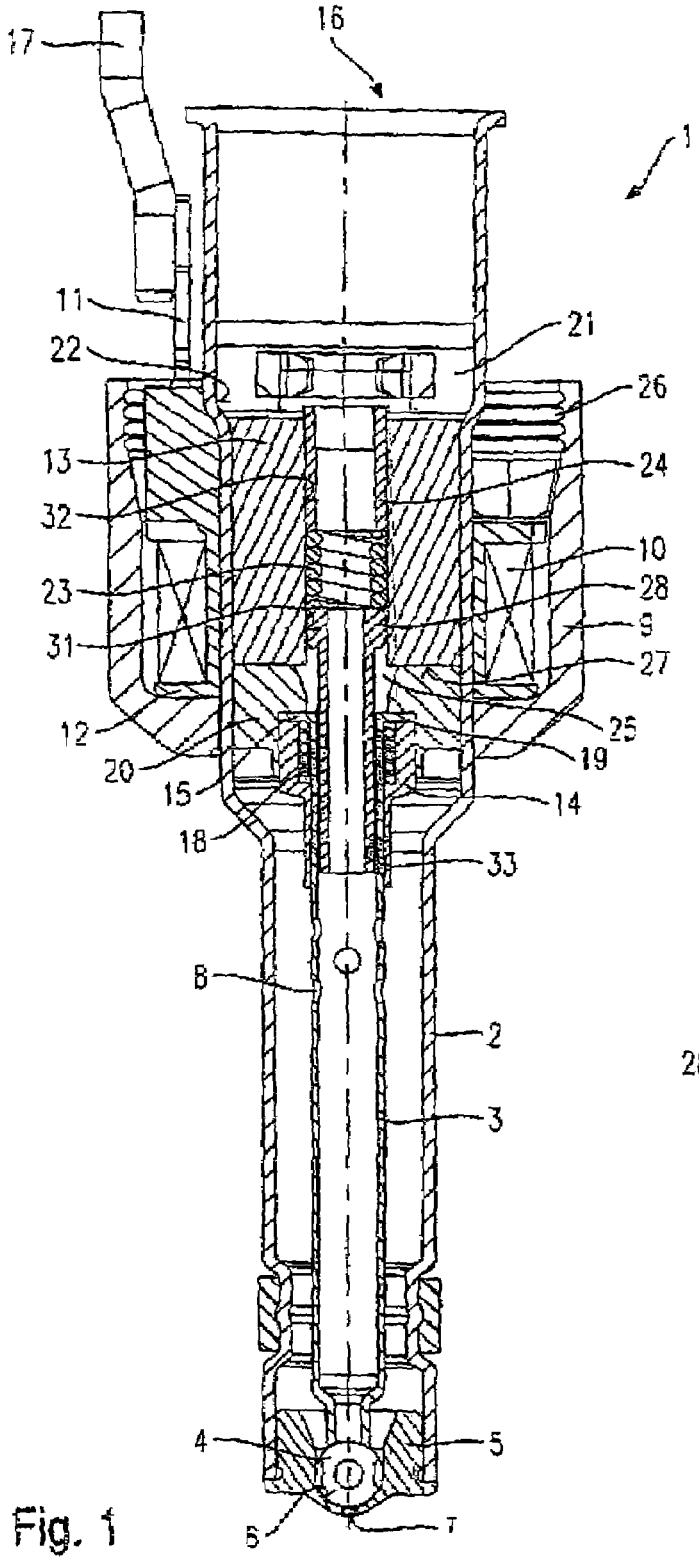
FIG. 1 illustrates a schematic section through an exemplary embodiment of a fuel injector configured according to the present invention.

In a part-sectional representation, FIG. 1 shows an exemplary embodiment of a fuel injector 1 configured according to the present invention. It is in the form of a fuel injector 1 for fuel-injection systems of mixture-compressing internal combustion engines having external ignition. Fuel injector 1 may be suited for the direct injection of fuel into a combustion chamber of an internal combustion engine.

Fuel injector 1 is made up of a tubular nozzle body 2, in which a valve needle 3 is positioned. Valve needle 3 is in operative connection with a valve-closure member 4, which cooperates with a valve-seat surface 6 positioned on a valve-seat member 5 to form a sealing seat. Fuel injector 1 in the exemplary embodiment is an inwardly opening fuel injector 1 which has at least one spray-discharge orifice 7.

Nozzle body 2 penetrates a cup-shaped outer pole 9 of a magnetic coil 10, which is sealed from an environment of fuel injector 1, for instance, by a labyrinth seal 26. Magnetic coil 10 is wound on a coil brace 12 and cooperates with an inner pole 13 of magnetic coil 10 located in nozzle body 2. Magnetic coil 10 is energized via a line 11 by an electric current which may be supplied via an electrical plug contact 17. Plug contact 17 may be encased by a plastic coating.

Valve needle 3, via a flange 14 in which valve needle 3 is inserted, is in force-locking connection with an armature 20. Positioned between flange 14 and a shoulder 15 of valve needle 3 is a prestroke-spring 18, which provides armature 20 with an armature free path during activation of fuel injector 1 and thereby may allow a rapid opening of fuel injector 1.

Positioned in a bore 32 of inner pole 13 of fuel injector 1 is a restoring spring 23 which is prestressed by a sleeve 24 in the exemplary configuration of fuel injector 1.

According to an exemplary embodiment of the present invention, restoring spring 23 is braced against a guide sleeve 28, which is inserted in an axial opening 33 of valve needle 3 and may be pressed together with valve needle 3. The exemplary measures according to the present invention may prevent restoring spring 23 which, according to the related art, may be braced directly against shoulder 15 of valve needle 3, from moving into a recess 25 of fuel injector 1 during operation of fuel injector 1. Instead, it may remain completely at inner pole 13. The movement of restoring spring 23 may cause malfunctions of fuel injector 1 which may even result in jamming of restoring spring 23, uneven wear manifestations and deformations of shoulder 15 of valve needle 5.

Figure 2:
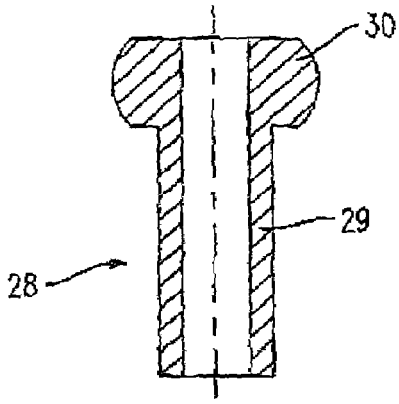
FIG. 2 illustrates an enlarged schematic section through an exemplary embodiment of a guide sleeve of the fuel injector configured according to the present invention.

Guide sleeve 28 extends through armature 20 and also, at least partially, into bore 32 of inner pole 13 of magnetic coil 10. As may be inferred from the enlarged schematic representation of guide sleeve 28 in FIG. 2, guide sleeve 28 may be embodied as a hollow cylinder and may have a tubular shaft 29 in the area of valve needle 3 and armature 20, and a guide section 30 in the region of inner pole 13. Guide sleeve 28 may be produced in a simple and cost-effective manner, for instance, by turning.

Guide section 30 of guide sleeve 28 may have the shape of a sphere segment and may be dimensioned so that it rests against an inner wall 31 of bore 32 of inner pole 13. This may cause guide section 30 of guide sleeve 28 to move only along inner wall 31 of inner pole 13 during operation of fuel injector 1. The sphere-segment shape may contribute to a low-friction guidance, thereby not adversely influencing the dynamics of fuel injector 1. The axial length of restoring spring 23 may be smaller than the axial length of bore 32 of inner pole 13, regardless of the switching position of fuel injector 1. Consequently, restoring spring 23 may be restricted from projecting out from inner pole 13 and thus may be prevented from shifting into recess 25 of fuel injector 1.

The fuel may be conveyed to fuel injector 1 by a fuel-distributor line via a central fuel supply 16. The fuel may be conveyed to the sealing seat via recess 25, guide sleeve 28, tubularly embodied valve needle 3 and flow-through orifices 8 in valve needle 3.

In the rest state of fuel injector 1, restoring spring 23 may provide an initial stress to valve needle 3 via guide sleeve 28 so that valve-closure member 4 is sealingly held at valve-seat surface 6, thereby keeping fuel injector 1 closed. A working gap 27 formed between armature 20 and inner pole

13 is closed as is a prestroke gap 19 formed between flange 14 and shoulder 15 of valve needle 3.

In response to magnetic coil 10 being energized via the electric line 11 using plug contact 17, a magnetic field is built up which pulls armature 20 to inner pole 13, counter to the force of restoring spring 23. First, prestroke gap 19 between flange 14 and shoulder 15 of valve needle 3 and subsequently working gap 27 between armature 20 and inner pole 13 is closed. The fuel conveyed via central fuel supply 16 may flow to the sealing seat through bore 25 in armature 20 and valve needle 3.

If the coil current is switched off, armature 20 falls away from inner pole 13 after sufficient decay of the magnetic field, due to the pressure of restoring spring 23, whereupon valve needle 3, which, via guide sleeve 28, is in operative connection with flange 14 at armature 20, moves in a direction counter to the lift direction. As a result, valve closure member 4 comes to rest on valve-seat surface 6, and fuel injector 1 is closed.

The present invention is not limited to the exemplary embodiment shown and is also applicable, for instance, to fuel injectors 1 for mixture-compressing, self-ignitable internal combustion engines.

What is claimed is:

1. A fuel injector, comprising:

a valve needle having an axial opening;

a guide sleeve inserted in the axial opening;

an armature and the valve needle together forming an axially movable part;

a magnetic coil having an inner pole and cooperating with the armature;

a restoring spring arranged to rest against the guide sleeve and to act upon the armature;

a valve-seat member; and a valve-closure member provided at the valve needle, the valve-closure member forming a sealing seat with the valve seat member, wherein the guide sleeve has a tubular shaft in an area of the valve needle and armature, and a guide section in a region of the inner pole, the guide section arranged as a sphere-segment.

2. The fuel injector according to claim 1, wherein the guide sleeve penetrates the armature and is in force-locking connection to the armature and the valve needle.

3. The fuel injector according to claim 1, wherein the tubular shaft is configured to be pressed into the axial opening of the valve needle.

4. The fuel injector according to claim 1, wherein the guide section is configured to be guided in a moveable manner in the inner pole.

5. The fuel injector according to claim 4, wherein the inner pole has a bore having an inner wall and the guide section is configured to rest against the inner wall and is guided therewith.

* * * * *